US006364115B1

(12) United States Patent
Casanova et al.

(10) Patent No.: US 6,364,115 B1
(45) Date of Patent: Apr. 2, 2002

(54) BATTERY PACKAGE WITH ROTATION PREVENTION

(75) Inventors: Julio C. Casanova, Avon Lake; Jean-Marie Weisskopf, Bay Village, both of OH (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 09/595,502

(22) Filed: Jun. 16, 2000

(51) Int. Cl.[7] ..... B65D 73/00
(52) U.S. Cl. ..... 206/471
(58) Field of Search ..... 206/703, 705, 206/461, 462–465, 467, 470, 471, 443, 446, 806

(56) References Cited

U.S. PATENT DOCUMENTS 4,456,124 A * 6/1984 Kay et al. ..... 206/470
4,724,964 A * 2/1988 Hernandez ..... 206/461
4,958,731 A * 9/1990 Calcerano ..... 206/705
5,311,989 A 5/1994 Ward et al.
5,560,490 A * 10/1996 Chawla ..... 206/471
6,050,415 A * 4/2000 Lina et al. ..... 206/462
6,053,320 A * 4/2000 Kuethe ..... 206/462

* cited by examiner

*Primary Examiner*—Luan K. Bui
(74) *Attorney, Agent, or Firm*—Stewart A. Fraser

(57) ABSTRACT

A product display package that houses generally cylindrical products, such as batteries, and prevents rotation of the products. The product display package comprises a container having a housing defining a compartment adapted to house products. The container includes a plurality of parallel pockets having a length and width and each configured to receive a product. Inward protrusions are formed in the first and second ends to hold the products in place and prevent rotation of the products. Additional protrusions are formed in the package to contact side walls of the product to further prevent rotation.

16 Claims, 6 Drawing Sheets

BATTERY PACKAGE WITH ROTATION PREVENTION

BACKGROUND OF THE INVENTION

The present invention generally relates to packages for displaying products for sale and, more particularly, to a display package for containing cylindrical products, such as batteries, for display to consumers while preventing rotation of the products within the package.

A common practice for packaging and displaying small and lightweight retail items, such as cylindrical alkaline batteries, is to package the items in thermoformed blister packages and place the packages on shelves or hang the packages on hooks on various display racks. Conventional battery packages are generally composed of a display card which provides a generally stiff supportive backing, usually composed of cardboard, and a thermoformed polymeric blister that is bonded or otherwise attached to the display card. The display card provides support for displaying the merchandise for sale and usually contains print with suitable indicia, such as advertising, trademarks, and instructions.

With battery display packages, batteries of the same size are commonly made available to consumers for purchase in a package containing a predetermined number of batteries. The batteries are displayed and sold in blister-type packages which usually contain two, four, or eight batteries commonly packaged in each display package. In accordance with one battery packaging approach, the thermoformed blister generally comprises a piece of transparent polymeric material, e.g., plastic, heat sealed to the front side of the display card. According to another approach, a clam-type thermoformed polymeric blister generally having a shape to fit over and cover the batteries is supported on the cardboard display card. The clam-type polymeric blister typically has two pieces, each having a peripheral flange glued between the two layers of the cardboard of the display card. The blister isolates the product from the purchaser and prevents inadvertent damage to the product that can result from repeated handling prior to sale. Moreover, the blister allows for the orderly display of products for sale to purchasers.

In order to maximize marketability of the product, it is desirable to orient some products, such as cylindrical alkaline batteries, within the blister package so that the graphics printed on the product label are readily recognized and appear more attractive to consumers, especially when the products are packaged in clear (transparent) blister packages. In the past, some battery packaging techniques have employed a registration mark on each battery so that the batteries can be disposed in the blister package in a desired orientation so as to maximize display of the label print. However, once oriented in the blister package, the batteries should be retained in the desired orientation, and therefore rotation of batteries should be prevented.

One approach for packaging batteries in a blister package having a blister bonded to a backing card and preventing rotation of the batteries is disclosed in U.S. Pat. No. 5,311,989. The aforementioned patent discloses employing protrusions formed in the end walls of the blister pockets that engage the positive and negative terminals of the batteries to prevent rotation of the batteries within the package, and further allows for engagement of batteries which may have varying sizes. The aforementioned approach requires complex retention features formed in the end walls of the pockets which may complicate the blister manufacturing process. Additionally, the retention features may be susceptible to excessive deformation.

Accordingly, there is a need, heretofore unfulfilled, for a product display package for displaying cylindrical products for sale to consumers while preventing rotation of the products. It is particularly desirable to provide for a battery display blister package that houses cylindrical batteries while preventing rotation of the batteries so as to maximize display of the label print indicia to consumers.

SUMMARY OF THE INVENTION

The present invention provides for a product display package that houses generally cylindrical products and prevents rotation of the products within the package. To achieve this and other advantages, and in accordance with the purpose of the present invention as embodied and described herein, the present invention provides for a product display package comprising a container having a housing defining a compartment adapted to house one or more products. The container includes at least one pocket, and preferably has a plurality of substantially parallel pockets. Each pocket has first and second ends and side walls extending between the first and second ends with a length and a width configured to receive a generally cylindrical product. The first and second ends each include an inward protruding retaining member integrally formed in the pocket and configured to engage a surface on the product to bias the product toward the side walls. The retaining members are adapted to engage depressions in the ends of the product to hold the product in place and prevent rotation of the product. According to one aspect of the present invention, one or more depressions are formed in the container and are adapted to engage the cylindrical side walls of the product. According to another aspect of the present invention, the container includes a base, a top, and a hinge connecting the base and the top, wherein one or more depressions are formed in the base and adjacent to the hinge so as to counteract any outward bowing of the base when the top is closed onto the base.

These and other features and advantages of the present invention will be further understood and appreciated by those skilled in the art by reference to the following specification, claims and appended drawings.

DETAILED DESCRIPTION OF THE PREFERRED EMBODIMENTS

Figure 1:
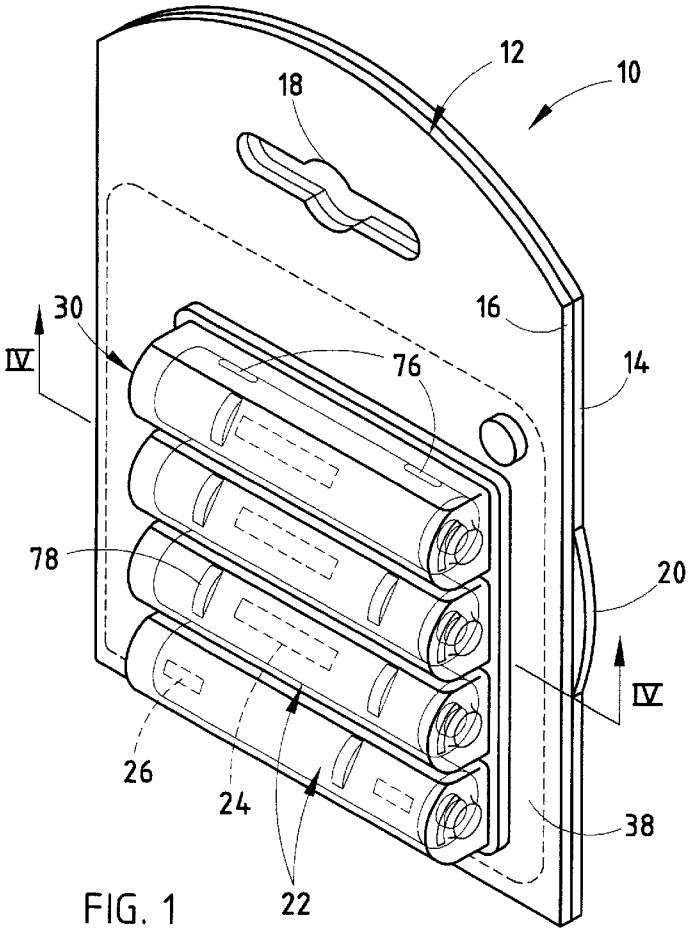
FIG. 1 is a front perspective view of a battery display blister package according to one embodiment of the present invention.
Figure 12:
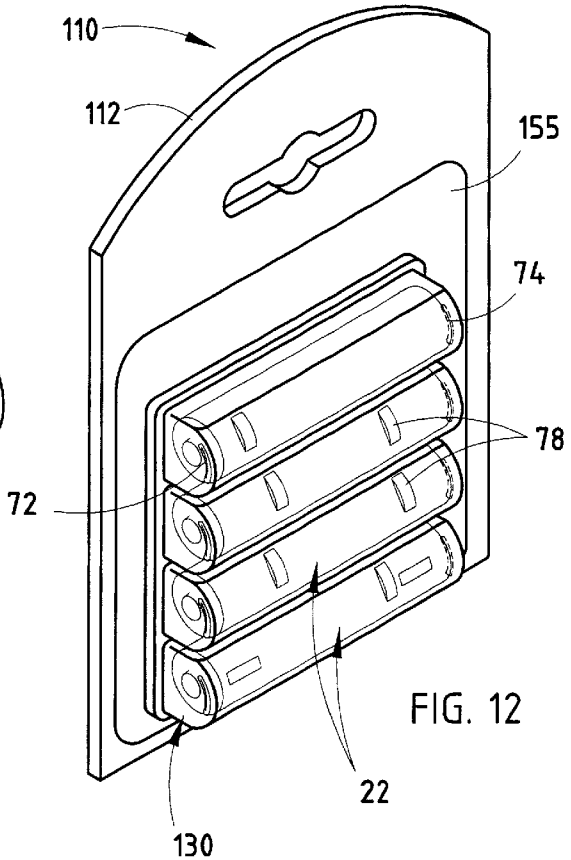
FIG. 12 is front perspective view of a battery display blister package according to another embodiment of the present invention.

For purposes of description herein, the terms "upper," "lower," "right," "left," "rear," "front," "vertical," "horizontal" and derivatives thereof shall relate to the invention as oriented in FIGS. 1 and 12. However, it is to be understood that the invention may assume various alternative orientations and step sequences, except where expressly specified to the contrary. It is also to be understood that the specific devices illustrated in the attached drawings, and described in the following specification are simply exemplary embodiments of the inventive concepts defined in the appended claims. Hence, specific dimensions and physical characteristics relating to the embodiments disclosed herein are not to be considered as limiting, unless the claims expressly state otherwise.

Referring to FIG. 1, a product display package 10 is shown packaging a plurality of cylindrical batteries, such as AA-size batteries 22, for display and sale to consumers in a retail store according to one embodiment. The product display package 10 shown houses four cylindrical AA-size batteries 22, according to one example, in a combination display card and reclosable blister merchandise container. While a battery blister package is shown and described herein, it should be appreciated that the present invention provides a product display package that may house generally cylindrical products of various sizes and numbers, which may include batteries as well as other types of products, without departing from the spirit of the present invention.

The product display package 10 includes a display card 12 having a substantially planar main body, and a polymeric blister merchandise container 30 supported by the display card 12. The display card 12 is made up of two layers of material, including a rear layer of cardboard 14 bonded to a front layer of cardboard 16. Layers 14 and 16 may include two separate sheets of cardboard substantially similarly shaped and bonded together via glue. Alternatively, layers 14 and 16 may be formed from a single sheet of cardboard that is folded along one edge, such as the lower edge, and pressed and bonded together. Display card 12 generally includes a lower edge, two vertical side edges on the left and right sides, and a rounded upper edge. Formed near the upper edge of display card 12 is a cutout aperture 18 which allows the display card 12 to be hung from a hook on a display rack. In addition, the display card 12 may contain print with indicia such as advertising, trademarks, and instructions, as is commonly practiced in the art.

The merchandise container 30 as shown in this embodiment is a reclosable and reusable transparent thermoformed blister container that houses battery products. The merchandise container 30 has a peripheral flange 38 formed around a perimeter of the main housing compartment and extending radially outward. The peripheral flange 38 is sandwiched between the rear and front layers 14 and 16, respectively, of display card 12. Merchandise container 30 extends through an aperture formed in the front layer or, alternately, in both the front and rear layers 14 and 16, of display card 12. The peripheral flange 38 is sandwiched between rear and front layers 14 and 16, and may or may not be bonded to the display card 12. Accordingly, merchandise container 30 is trapped in place between the front and rear layers 14 and 16 of display card 12, prior to the display card 12 being torn open.

Figure 2:
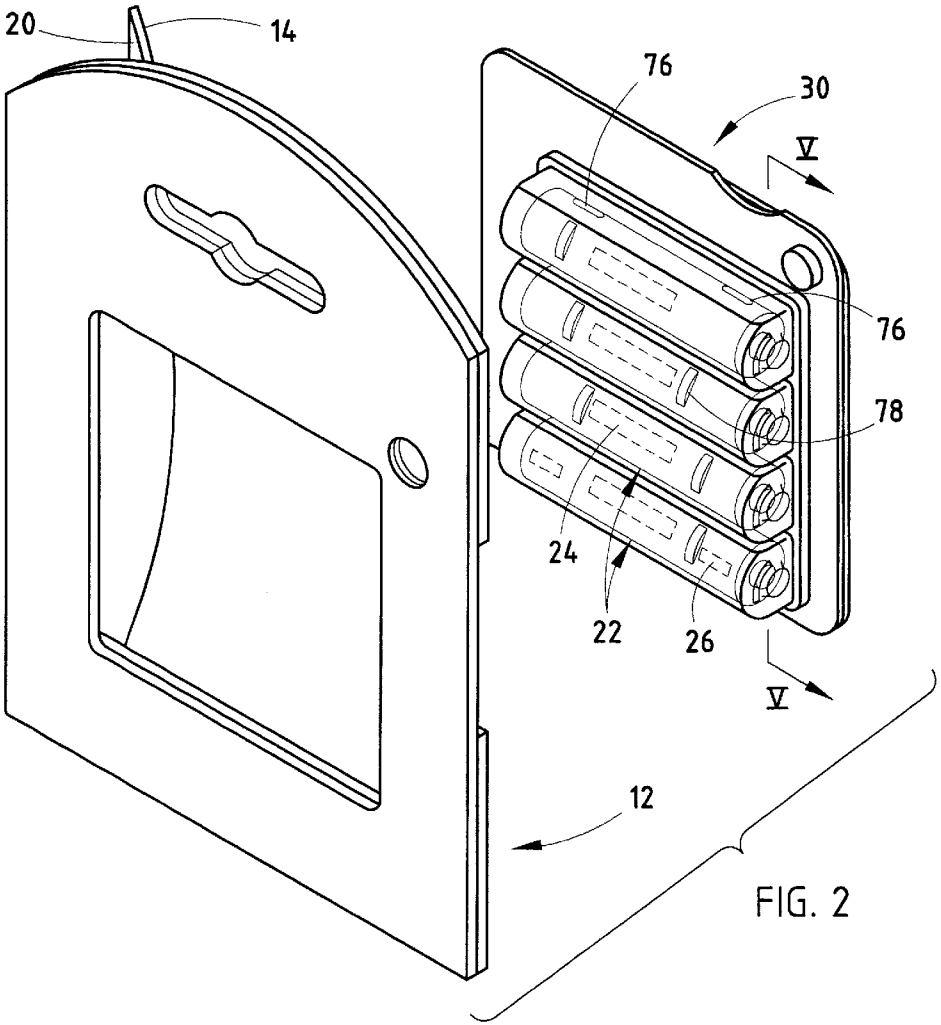
FIG. 2 is an exploded view of the package showing removal of the blister container from the display card.

The product display package 10 is further shown in FIG. 2 with the blister merchandise container 30 removed from the display card 12. According to one example, a tab 20 may be torn along perforations in the rear layer 14 of display card 12 to allow for removal of container 30 from display card 12. As shown, each of the batteries 22 is oriented in a desired orientation within the blister container 30. The batteries 22 may be oriented and disposed within the blister container 30 in accordance with known orientation techniques. The blister merchandise container 30 fixedly holds each of the batteries 22 in place to prevent movement of the batteries 22 relative to the blister container 30 following package assembly. Accordingly, each of the batteries 22 may remain oriented in a desired orientation to provide a battery package 10 that is aesthetically pleasing to consumers and has the maximum positive impact on consumers.

Each of the batteries 22 shown generally has a steel can containing electrochemically active materials. The battery can generally has a closed bottom end, cylindrical side walls, and an open top end sealed closed with a cover and seal assembly as is well-known in the battery manufacturing art. The battery also has a label applied to the outer cylindrical walls of the can as is generally known in the battery art. The battery label preferably includes print containing suitable indicia, such as advertising, trademarks, and instructions, and may further include a battery tester, as shown by reference numeral 26, or other viewable features. A substantial amount of space on the battery label may contain print so as to maximize use of the battery label space to advertise the product and provide packaged products that are aesthetically pleasing to consumers. It is desirable to orient the batteries 22 to display certain features on the label. For example, some of the batteries may be oriented to display the brand name and logo in the region identified by reference numeral 24, while one or more batteries 22 may be oriented to display the battery tester 26. The package 10 of the present invention prevents the batteries 22 from rotating from the orientation of the batteries as packaged.

Figure 3:
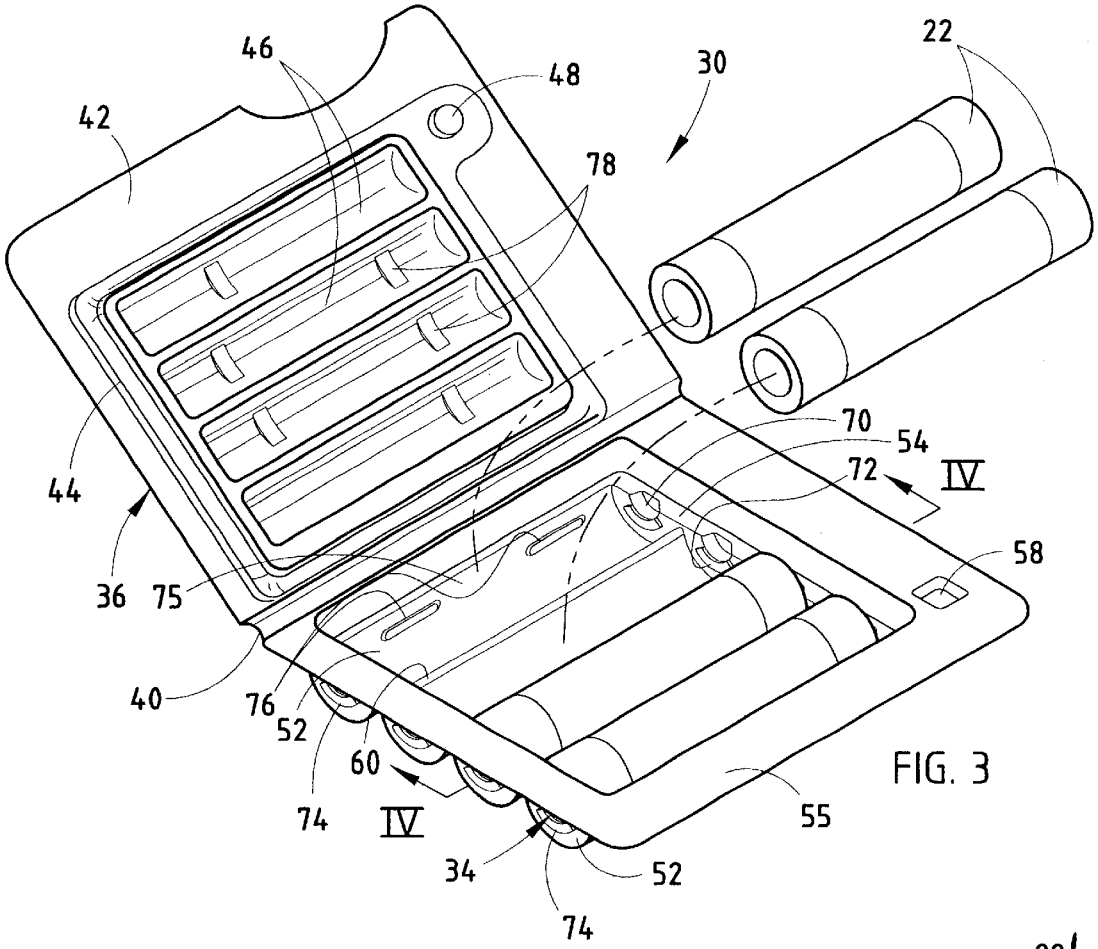
FIG. 3 is a perspective view of the blister container shown in an open position.

The blister merchandise container 30 is further shown in FIG. 3. The merchandise container 30 includes a front base housing 34 and a rear lid 36 connected via an integrally formed hinge 40 that allows for pivoting of the lid 36 relative to the base housing 34. Rear lid 36 has a partially planar rear surface 42 that is substantially flush mounted against the rear layer 16 of display card 12. Integrally formed in the rear lid 36 is a generally rectangular upstanding wall 44 which defines a cavity with compartment pockets 46 formed therein for receiving the rear surface of generally cylindrical products, such as batteries.

The front base housing 34 has a partially planar member 55 with a generally rectangular recessed wall 54 that forms molded front compartment pockets 52 which, together with rear compartment pockets 46, contain products therein. Compartment pockets 52 form an outward protruding surface and substantially conform to the size and shape of the products, such as batteries 22. The planar members 42 and 55 are intended to be flat against one another around the perimeter area when the merchandise container 30 is closed. In addition, the rear lid 36 has a round, disk-like, protruding male member 48 adapted to fit into rectangular female receptacle 58 formed in front base housing 34. Together, the round male member 48 and rectangular female receptacle 58 form a snap-fit closure. It should be appreciated that the upstanding wall 44 is generally rectangular and is adapted to be received by generally rectangular recessed wall 54 to form an interference fit closure of the container 30. The addition of the snap-fit closure provides an added means of closure and also serves as an identifier to let consumers know that merchandise container 30 is reclosable and reusable. The merchandise container 30 may be configured with the interference fit closure between the front base housing 34 and rear lid 36, with or without the snap-fit closure.

The front base housing 34 of merchandise container 30 includes a plurality of substantially parallel pockets 52, such as the four pockets shown for holding four AA-size batteries, respectively. The pockets 52 are generally formed each having a length and a width configured to receive a corresponding battery 22. Adjacent pockets 52 are separated via an integrally formed divider 60. Each pocket 52 includes an outward protrusion 70 for receiving the positive terminal nubbin of battery 22. In addition, an inward protrusion 72 is formed in each pocket at one end and is adapted to engage the positive terminal at a location near the rim of the battery 22. At the opposite end of each pocket 52 is an inward protrusion 74 which is adapted to engage a depression near the rim of the negative terminal of battery 22. Inward protrusions 72 and 74 extend a depth sufficient to engage and hold the battery 22 within pocket 52 so as to prevent rotation of the battery 22 relative to the corresponding pocket 52. According to the embodiment shown, the inward protrusions 72 and 74 are generally configured as arcuate depressions. Accordingly, rotation of the batteries 20 is prevented so as to maintain the desired packaged orientation for display to consumers.

Figure 4:
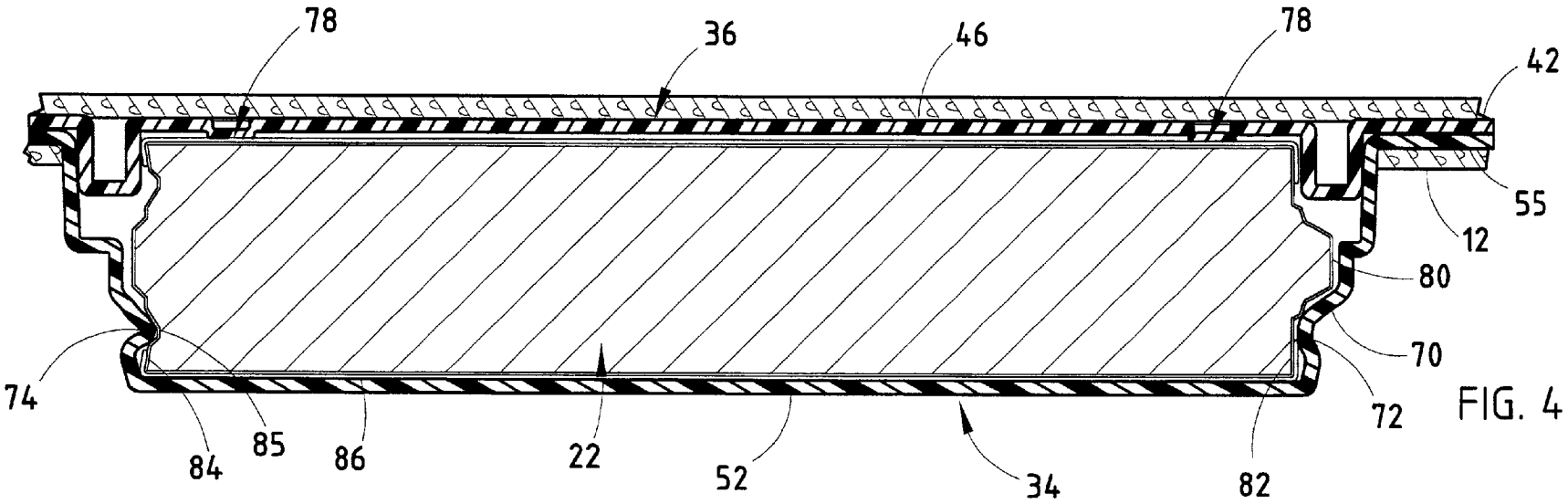
FIG. 4 is a cross-sectional view of the blister package taken through lines IV—IV in FIG. 1.

Referring to FIG. 4, the engagement of inward protrusions 72 and 74 with the positive and negative terminals of battery 22 is further illustrated therein. The battery 22 has a positive terminal nubbin 80 disposed within a greater size outward protrusion 70 formed in one end of pocket 52. The inward protrusion 72 engages the positive terminal near the end of label 86, and may engage a depression formed at the end of label 86. Likewise, at the negative end of battery 22, inward protrusion 74 engages a depression 84 formed in the negative terminal of battery 22. Together, inward protrusions 72 and 74 provide a retainer by which the battery 22 can be inserted into the pocket 52 and forcibly snapped into place such that inward protrusions 72 and 74 retain the opposite ends of battery 22 so as to hold the battery 22 against the polymeric blister with an interference fit, and thereby prevent rotation of battery 22 relative to pocket 52. When each battery 22 is forcibly snapped into position within the pocket 52, the ends of pocket 52 flex outward to allow the battery terminals to slide across protrusions 72 and 74 and lock into therewith engagement.

Figure 5:
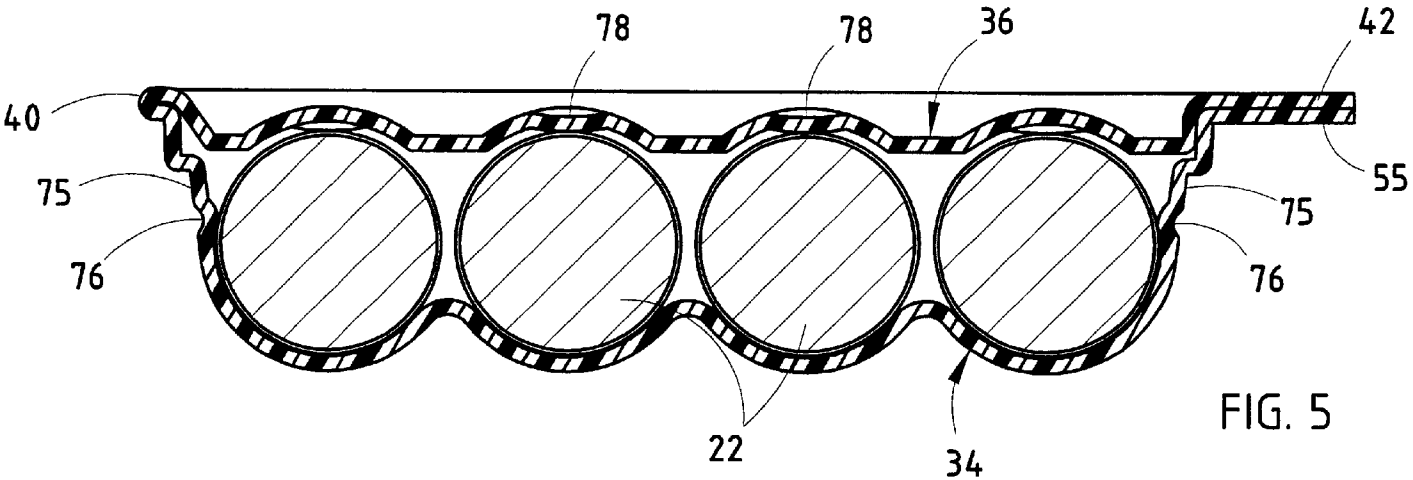
FIG. 5 is a cross-sectional view of the blister package taken through lines V—V in FIG. 2.

As is particularly shown in both FIGS. 4 and 5, batteries 22 are held in place at opposite ends via protrusions 72 and 74, and are further engaged on the side walls via inward protrusions 78 and 76, to further prevent rotation of batteries 22 within the package. For the AA-size battery package shown, inward protrusion 72 engages the positive terminal (cover) of battery 22 between a protruding annular rim 82 and the central nubbin 80 of the positive terminal. The inward protrusion 72 preferably contacts the end of label 86. The inward protrusion 74 engages a depression 85 in the negative cover of battery 22 between a protruding annular rim 84 and the central region of the negative cover. The protrusion 74 preferably contacts the inward edge of annular rim 84 such that the side walls of the battery are pressed against the blister pocket 52. Accordingly, the opposite ends (positive and negative ends) of each battery 22 are held in contact with the blister package and the side walls are forced against the blister material to prevent rotation of battery 22 relative to the blister package.

The inward protrusions 78 formed in rear compartment pockets 46 of the rear lid 36 are spaced apart and are adapted to engage the side walls of batteries 22 when rear lid 36 is closed against base housing 34. Inward protrusions 78 are adapted to apply a force onto the side walls of batteries 22 to further bias the batteries 22 against the blister material and further aid to prevent rotation of each battery 22. By providing inward protrusions 78 to engage each battery 22, consistent friction engagement with the side walls of battery 22 is ensured, despite small variations in the blister materials or battery size and flexure of the blister material. The inward protrusions 78 are preferably spaced apart and are located such as not to interfere with the battery tester on the label.

The elongated inward protrusions 76 formed in the upper and lower recessed walls 75 of front base housing 54 are adapted to abut the batteries 22 in the uppermost and lowermost end pockets 52. A first pair of protrusions 76 are located slightly below the hinge 40 to counteract the outward bowing of the blister walls which may occur when the rear lid 36 of the blister is closed over and secured to the base housing 34 of the blister. The lower side wall on the opposite end of the hinge 40 also includes a second pair of elongated inward protrusions 76 that oppose the first pair of indentations. While a total of four elongated inward protrusions 76 are shown, it should be appreciated that one or more elongated inward protrusions 76 may be formed in the side walls 75 of front base housing 34 below hinge 40, with or with one or more protrusions 76 in the opposite side wall.

Figure 6:
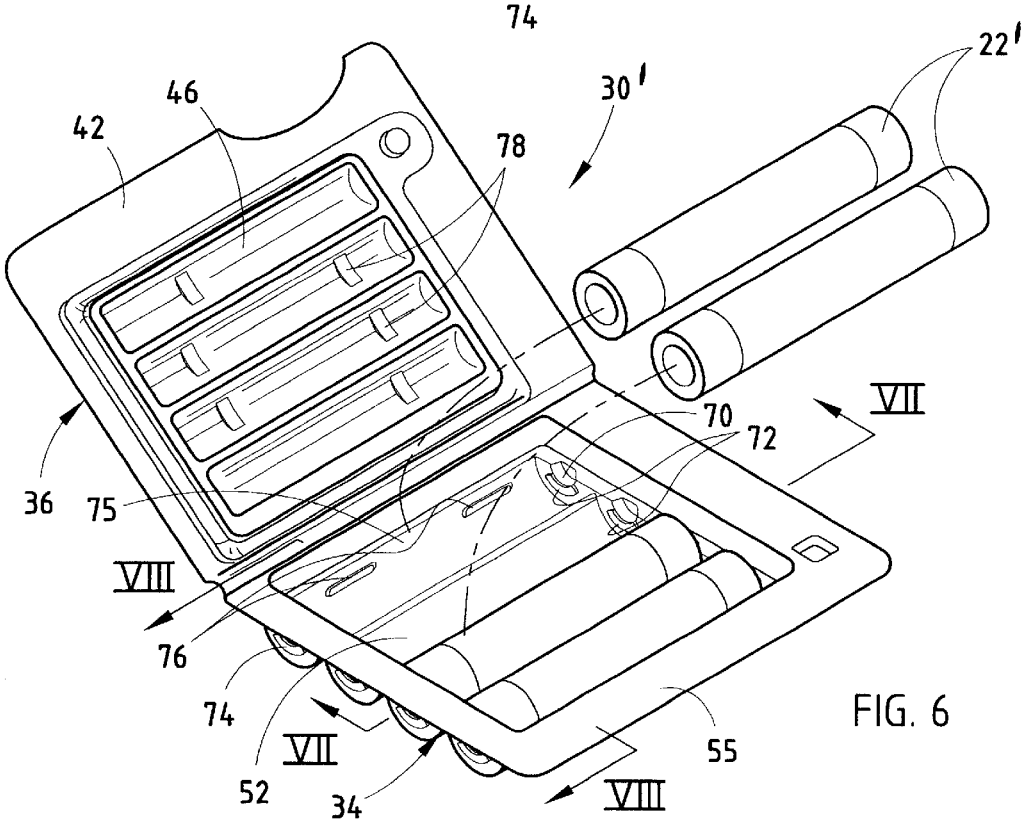
FIG. 6 is a perspective view of a blister container according to a second embodiment, shown in an open position without the display card.

Turning to FIG. 6, a polymeric blister merchandise container 30 is shown packaging a plurality of cylindrical batteries, such as AAA-size batteries 22', according to another example, for use in the combination display card and reclosable blister merchandise container as disclosed herein. Blister package 30' likewise includes a plurality of pockets 52 formed in a front face housing 34 and closable via a hingedly connected rear lid 36. Each pocket 52 includes inward protrusions 72 and 74 located at opposite ends for engaging the battery 22, as well as inward protrusions 76 formed in upper and lower side walls 75 and inward protrusions 78 formed in the rear compartment pockets 46 of rear leg 36. The AAA-size batteries 22' are likewise disposed in pockets 52 which are configured with a length and width to receive the individual batteries 22'.

Figure 7:
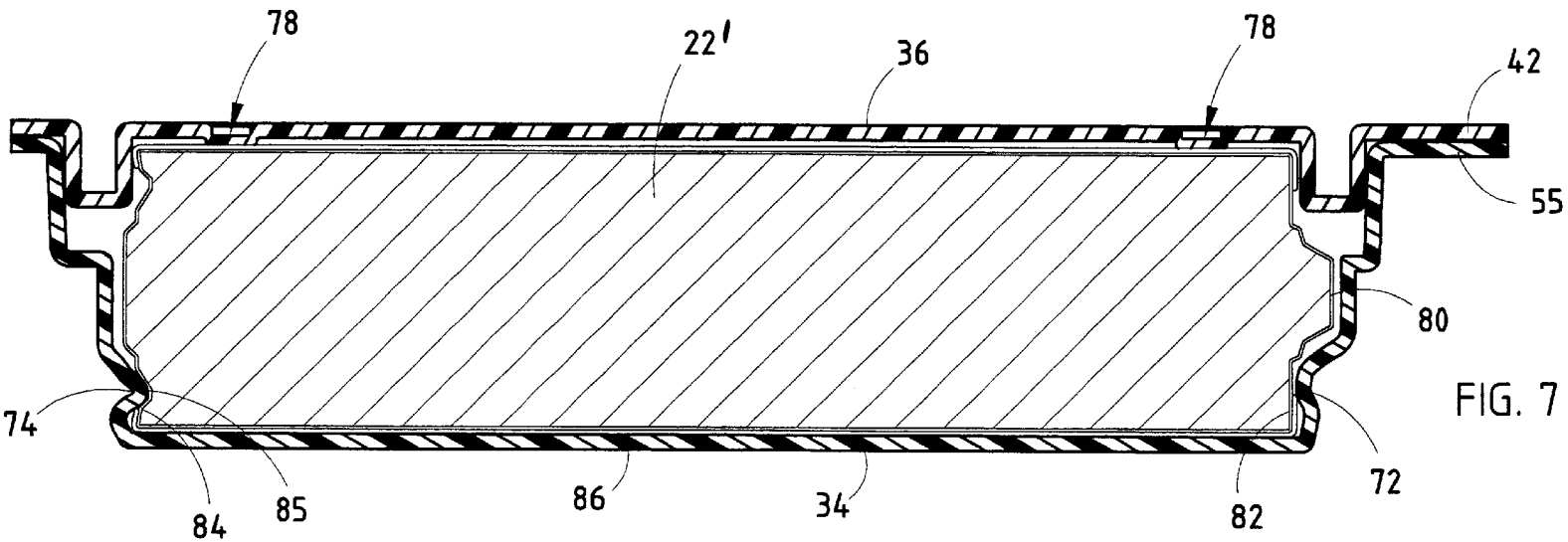
FIG. 7 is a cross-sectional view of the blister container taken through lines VII—VII in FIG. 6 and further shown in the closed position.
Figure 8:
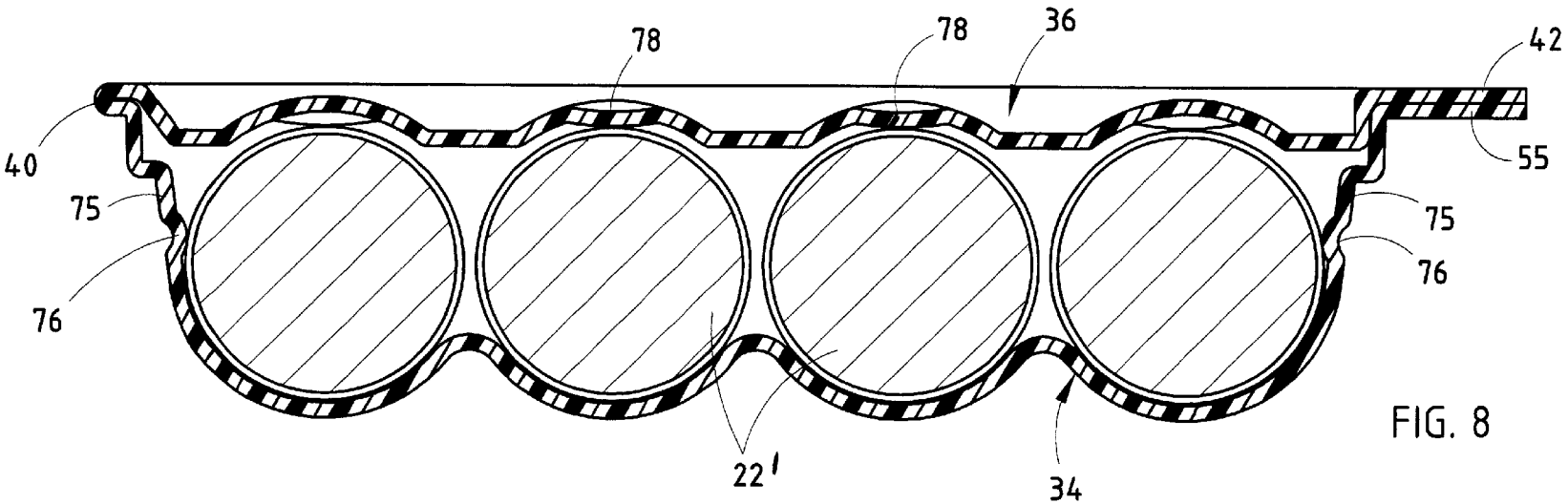
FIG. 8 is a cross-sectional view of the blister container taken through lines VIII—VIII in FIG. 6 and further shown in the closed position.

Referring to FIGS. 7 and 8, each battery 22' is fixedly held in blister merchandise 30 such that inward protrusions 72 and 74 engage opposite ends of battery 22'. Inward protrusion 72 contacts the positive terminal at a location near the outer rim and preferably abuts the end of label 86. The inward protrusion 74 engages an annular depression 85 formed between the annular rim 84 of battery 22' and a central portion of the negative terminal. The engagement of inward protrusion 74 in depression 85 is such that it abuts rim 84 so as to hold the battery 22' in place against the blister material so as to further prevent rotation of the battery 22'. In addition, the inward protrusions 78 formed in rear lid 36 engage the side walls of battery 22' when the blister container is closed. Further, inward depressions 76 formed in the upper and lower side walls 75 likewise further contact the batteries 22 at opposite ends so as to counteract any outward bowing of the polymeric blister to spring-like forces at the hinge 40.

Figure 9:
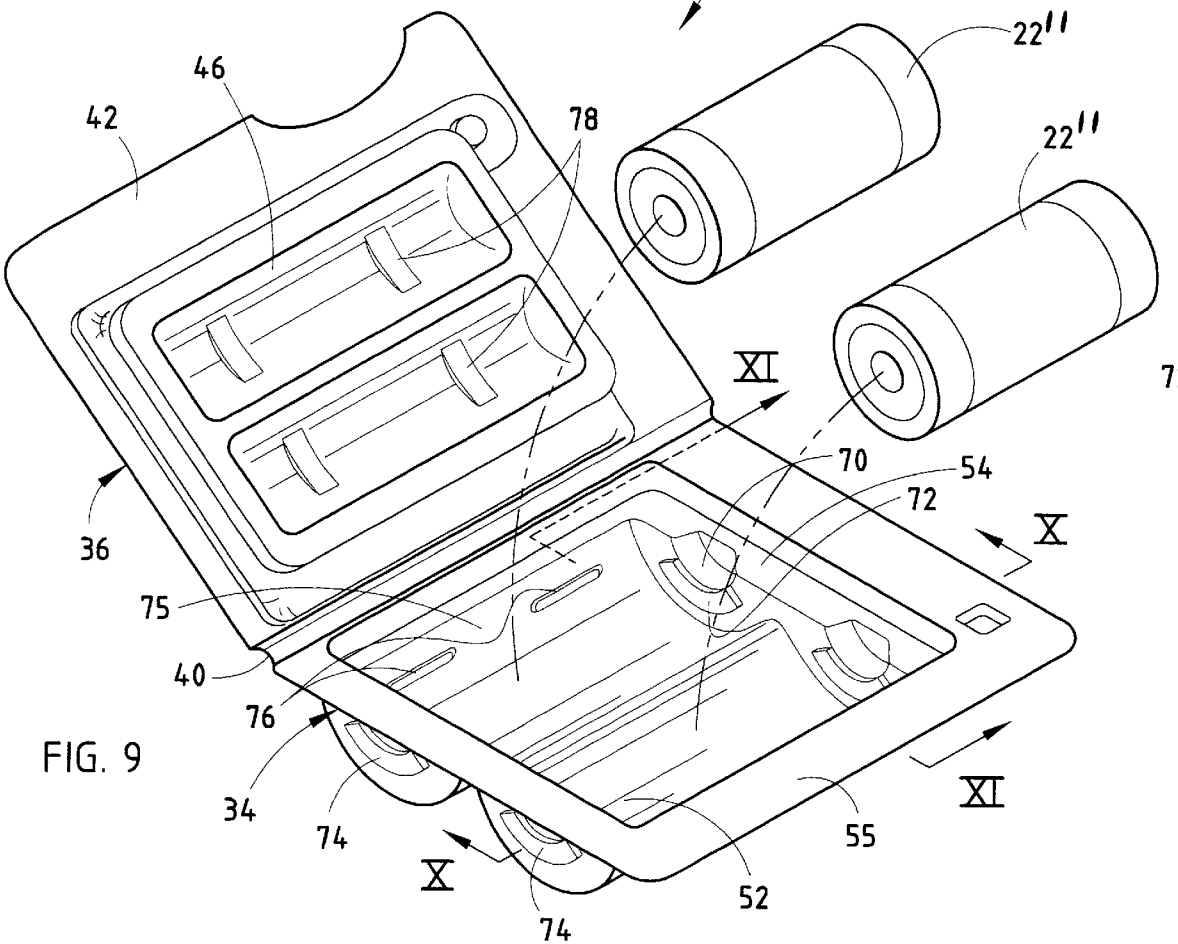
FIG. 9 is a perspective view of a blister container according to a third embodiment, shown in an open position without the display card.

Referring to FIG. 9, a polymeric blister merchandise container 30" is shown packaging a plurality of cylindrical batteries, such as C-size batteries 22", for use in a product display package 10 as discussed herein. The polymeric blister merchandise container 30" houses two C-size batteries 22". Blister container 30" likewise includes a front base housing 34 containing two pockets 52 pivotally connected to a rear compartment housing 42 via an integrally formed hinge 40. Each of pockets 52 includes inward protrusions 72 and 74 at opposite ends for engaging the positive and negative terminals of battery 22". In addition, inward protrusions 76 and 78 are likewise provided to contact the side walls of batteries 22".

Figure 10:
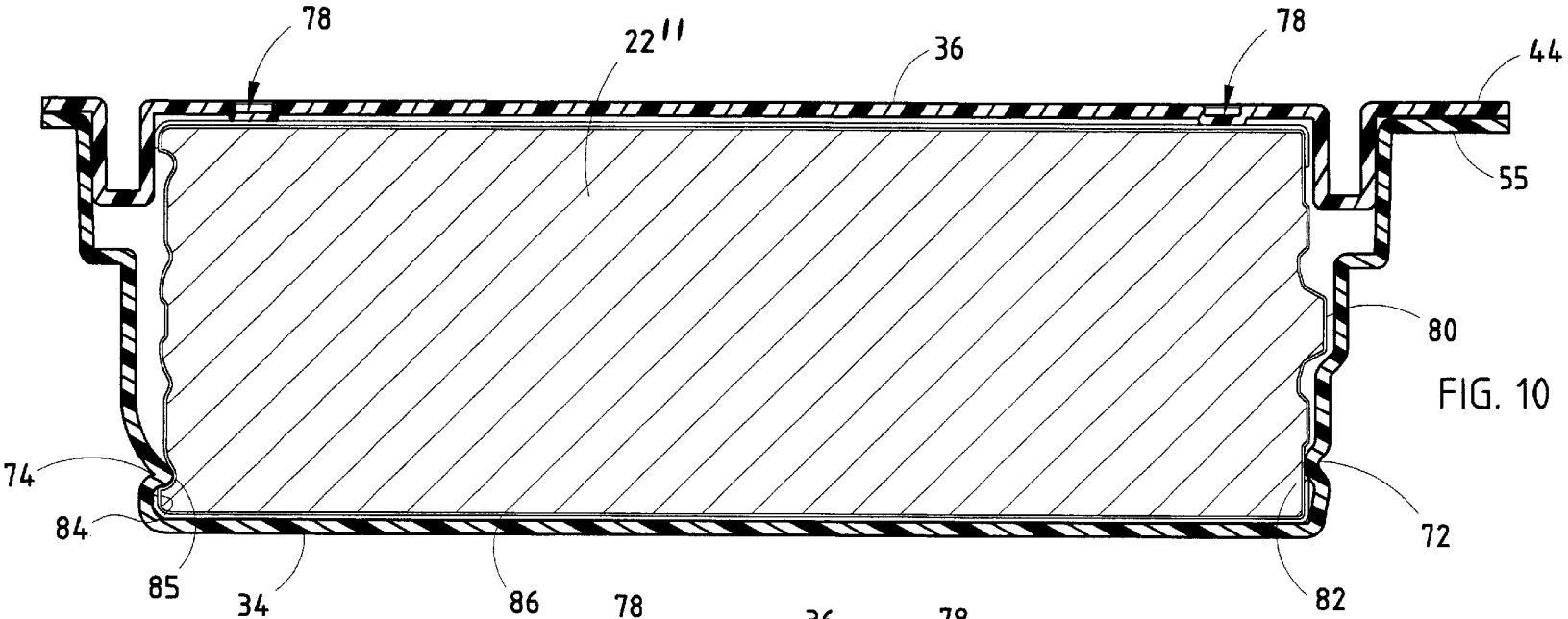
FIG. 10 is a cross-sectional view of the blister container taken through lines X—X in FIG. 9 and further shown in the closed position.
Figure 11:
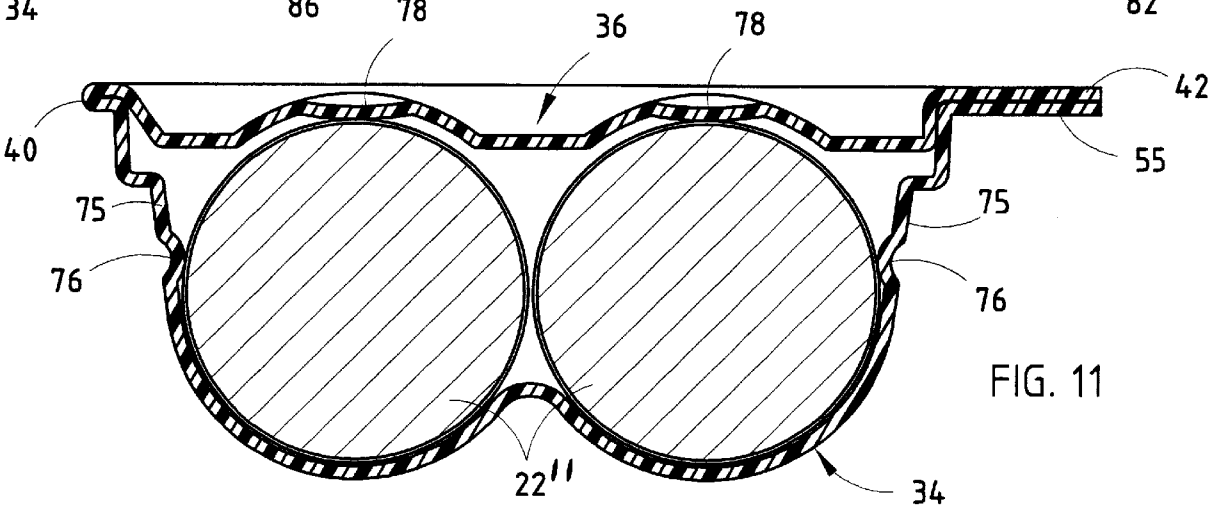
FIG. 11 is a cross-sectional view of the blister container taken through lines XI—XI in FIG. 9 and further shown in the closed position.

Referring to FIGS. 10 and 11, the inward protrusion 72 is shown contacting the positive terminal of battery 22" at a location adjacent to the end of label 86. Label 86 provides a ledge upon which inward protrusion 72 may become engaged and hold battery 22" against the blister material. At the opposite end, inward protrusion 74 engages depression 85 in battery 22" adjacent to the outer rim 84. The engagement of inward protrusion 74 in depression 85 abuts rim 84 such that the battery 22" is forced against the blister material to further prevent rotation thereof. In addition, inward protrusions 78 are formed in the rear lid and inward protrusions 76 are formed in the upper and lower side walls 75 to further prevent the rotation of batteries 22" as discussed herein.

Referring to FIG. 12, another embodiment of the product display package 110 is shown having a blister container 130 heat sealed to the front surface of a display card 112. The blister container 130 provides a compartment with one or more pockets, each for receiving a cylindrical product, such as an alkaline battery 22, to provide an interference fit that is similar to the engagement of batteries 22 in pockets 52 in the front base housing 34 as set forth in the embodiments shown in FIGS. 1–11. However, the blister package 110 is heat sealed along peripheral flange 155 against the display card 112 such that the display card 112 closes the compartment. The display card 112 may contact batteries 22 to further resist rotation of batteries 22.

Additionally, it should be appreciated that a friction surface may be employed on the inside surface of the blister pockets 52 or 152 to further prevent the rotation of products within the pockets 52 or 152. Alternately, or in addition, a friction surface may be provided on the batteries 22 to prevent rotation within the pockets 52 or 152 of the blister package 10 or 110. Accordingly, the addition of a friction surface further enhances the anti-rotation feature of the present invention.

Accordingly, the blister package 10 or 110 of the present invention advantageously displays products for sale to consumers, while preventing rotation of the products within the package. As a consequence, products can be oriented in a desired orientation to prominently display features found on the products and maintain orientation through shipping and handling prior to purchase by consumers. While the embodiments disclosed herein provide for a battery package, it should be appreciated that various other blister packages may employ the present invention to prevent rotation of various cylindrical or round products contained therein.

It will be understood by those who practice the invention and those skilled in the art, that various modifications and improvements may be made to the invention without departing from the spirit of the disclosed concepts. The scope of protection afforded is to be determined by the claims and by the breadth of interpretation allowed by law.

The invention claimed is:

1. A display package for retaining at least one product having a generally cylindrical wall, said package comprising:

a container having a housing defining a compartment adapted to house at least one product, said compartment including a pocket having a first end, a second end, and side walls extending between the first and second ends with a length and a width configured to receive a product;

a first inward protrusion formed in the first end of said pocket for engaging a first end of said product;

a second inward protrusion formed in the second end of said pocket and adapted to engage a second end of said product such that said first and second inward protrusions hold the product in place and in contact with the side walls of the container to prevent rotation of the product; and a third inward protrusion formed in said package for engaging side walls of said product to further prevent rotation of said product within said package, wherein said container further comprises a closable lid fit to engage said housing and close said compartment, wherein said third inward protrusion for contacting side walls of said product is formed in said closable lid.

2. The package as defined in claim 1, wherein said container comprises a transparent blister package.

3. The package as defined in claim 1, wherein said first and second inward protrusions each comprise arcuate annular members.

4. The package as defined in claim 1, wherein said package contains a plurality of generally cylindrical batteries.

5. A display package for retaining at least one product having a generally cylindrical wall, said package comprising:

a container having a housing defining a compartment adapted to house at least one product, said compartment including a pocket having a first end, a second end, and side walls extending between the first and second ends with a length and a width configured to receive a product;

a first inward protrusion formed in the first end of said pocket for engaging a first end of said product;

a second inward protrusion formed in the second end of said pocket and adapted to engage a second end of said product such that said first and second inward protrusions hold the product in place and in contact with the side walls of the container to prevent rotation of the product; and a third inward protrusion formed in said package for engaging side walls of said product to further prevent rotation of said product within said package, wherein said container further comprises a reclosable lid connected to said housing via an integrally formed hinge such that said closable lid is adapted to engage said housing to close said compartment, wherein said third inward protrusion adapted to engage side walls of said product is formed in said closable lid.

6. A display package for retaining at least one product having a generally cylindrical wall, said package comprising:

a container having a housing defining a compartment adapted to house at least one product, said compartment including a pocket having a first end, a second end, and side walls extending between the first and second ends with a length and a width configured to receive a product;

a first inward protrusion formed in the first end of said pocket for engaging a first end of said product;

a second inward protrusion formed in the second end of said pocket and adapted to engage a second end of said product such that said first and second inward protrusions hold the product in place and in contact with the side walls of the container to prevent rotation of the product;

a third inward protrusion formed in said package for engaging side walls of said product to further prevent rotation of said product within said package; and a display card having a main body integrally formed to engage and support said container, wherein said package comprises a closable lid fit to engage the housing and said container is trapped between two layers of said display card.

7. A display package for retaining products having a generally cylindrical wall, said package comprising:

a container having a housing defining a compartment adapted to house products, said compartment including a plurality of substantially parallel pockets each having a first end, a second end, and side walls extending between the first and second ends with a length and a width and configured to receive a product;

a first inward protrusion formed in the first end of each of said pockets for engaging a first end of said product;

a second inward protrusion formed in the second end of each of said pockets and adapted to engage a second end of said product such that said first and second inward protrusions hold the products in place and in contact with the side walls of the container to prevent rotation of the product; and a third inward protrusion formed in said package for engaging side walls of said product to further prevent rotation of said product within said package, wherein said container further comprises a closable lid fit to engage said housing and close said compartment, wherein said third inward protrusion for contacting side walls of said product is formed in said closable lid.

8. The package as defined in claim 7, wherein said product comprises a plurality of generally cylindrical batteries.

9. The package as defined in claim 7, wherein said container comprises a transparent blister package.

10. The package as defined in claim 7, wherein said first and second inward protrusions each comprise arcuate annular members.

11. The package as defined in claim 7 further comprising a display card having a main body integrally formed to engage and support said container.

12. A display package for retaining products having a generally cylindrical wall, said package comprising:

a container having a housing defining a compartment adapted to house products, said compartment including a plurality of substantially parallel pockets each having a first end, a second end, and side walls extending between the first and second ends with a length and a width and configured to receive a product; a first inward protrusion formed in the first end of each of said pockets for engaging a first end of said product;

a second inward protrusion formed in the second end of each of said pockets and adapted to engage a second end of said product such that said first and second inward protrusions hold the products in place and in contact with the side walls of the container to prevent rotation of the product; and a third inward protrusion formed in said package for engaging side walls of said product to further prevent rotation of said product within said package, wherein said container further comprises a reclosable lid connected to said housing via an integrally formed hinge such that said closable lid is adapted to engage said housing to close said compartment, wherein said third inward protrusion adapted to engage side walls of said product is formed in said closable lid.

13. A battery display package for retaining one or more batteries each having a generally cylindrical wall, said package comprising:

a container having a housing defining a compartment adapted to a house battery, said compartment including a pocket having a first end, a second end, and side walls extending between the first and second ends with a length and a width and configured to receive a battery;

a first inward protrusion formed in the first end of said pocket for engaging a first end of said battery;

a second inward protrusion formed in the second end of said pocket and adapted to engage a second end of said battery such that said first and second inward protrusions hold the battery in place and in contact with the side walls of the container to prevent rotation of the battery; and a third inward protrusion formed in said package for engaging side walls of said battery to further prevent rotation of said battery within said package, wherein said container further comprises a closable lid fit to engage said housing and close said compartment, wherein said third inward protrusion for contacting side walls of said product is formed in said closable lid.

14. The package as defined in claim 13, wherein said container comprises a transparent blister package.

15. The package as defined in claim 13, wherein said first and second inward protrusions each comprise arcuate annular members.

16. A battery display package for retaining one or more batteries each having a generally cylindrical wall, said package comprising:

a container having a housing defining a compartment adapted to a house battery, said compartment including a pocket having a first end, a second end, and side walls extending between the first and second ends with a length and a width and configured to receive a battery;

a first inward protrusion formed in the first end of said pocket for engaging a first end of said battery;

a second inward protrusion formed in the second end of said pocket and adapted to engage a second end of said battery such that said first and second inward protrusions hold the battery in place and in contact with the side walls of the container to prevent rotation of the battery; and a third inward protrusion formed in said package for engaging side walls of said battery to further prevent rotation of said battery within said package, wherein said container further comprises a reclosable lid connected to said housing via an integrally formed hinge such that said closable lid is adapted to engage said housing to close said compartment, wherein said third inward protrusion adapted to engage side walls of said product is formed in said closable lid.

* * * * *